US008262375B2

(12) United States Patent
Kojima et al.

(10) Patent No.: US 8,262,375 B2
(45) Date of Patent: Sep. 11, 2012

(54) TUBE PUMP AND ROTOR FOR TUBE PUMP

(75) Inventors: Seiji Kojima, Gunma (JP); Kou Sekiya, Gunma (JP); Junya Fujii, Hiroshima (JP); Shogo Kamito, Hiroshima (JP)

(73) Assignee: JMS Co., Ltd., Hiroshima (JP)

( * ) Notice: Subject to any disclaimer, the term of this patent is extended or adjusted under 35 U.S.C. 154(b) by 301 days.

(21) Appl. No.: 12/528,061

(22) PCT Filed: Feb. 18, 2008

(86) PCT No.: PCT/JP2008/052645
§ 371 (c)(1),
(2), (4) Date: Aug. 20, 2009

(87) PCT Pub. No.: WO2008/102723
PCT Pub. Date: Aug. 28, 2008

(65) Prior Publication Data

US 2010/0047100 A1 Feb. 25, 2010

(30) Foreign Application Priority Data

Feb. 20, 2007 (JP) ..... 2007-039442

(51) Int. Cl.
*F04B 43/12* (2006.01)
*F04B 45/06* (2006.01)

(52) U.S. Cl. ..... 417/477.7; 417/477.3; 417/477.8

(58) Field of Classification Search ..... 417/477.3, 417/477.7, 477.8, 477.1
See application file for complete search history.

(56) References Cited

U.S. PATENT DOCUMENTS

| | | | | |
|---|---|---|---|---|
| 2,804,023 | A * | 8/1957 | Lee | 417/477.7 |
| 2,955,543 | A * | 10/1960 | Daniels | 417/412 |
| 3,768,934 | A * | 10/1973 | Magerle | 417/477.3 |
| 3,963,023 | A * | 6/1976 | Hankinson | 604/19 |
| 4,363,609 | A * | 12/1982 | Cosentino et al. | 417/477.5 |
| 4,487,558 | A * | 12/1984 | Troutner | 417/477.7 |
| 4,564,342 | A * | 1/1986 | Weber et al. | 417/477.6 |
| 5,110,270 | A | 5/1992 | Morrick | |
| 5,263,831 | A * | 11/1993 | Kappus | 417/477.7 |
| 6,626,867 | B1 * | 9/2003 | Christenson et al. | 604/153 |
| 6,733,476 | B2 * | 5/2004 | Christenson et al. | 417/477.7 |

FOREIGN PATENT DOCUMENTS

| | | |
|---|---|---|
| GB | 193574 | 3/1923 |
| JP | 52704/1977 | 4/1977 |
| JP | 59-074387 | 4/1984 |
| JP | 60-75786 | 4/1985 |
| JP | 06-218042 | 8/1994 |

* cited by examiner

*Primary Examiner* — Peter J Bertheaud
(74) *Attorney, Agent, or Firm* — Patterson Thuente Christensen Pedersen. P.A.

(57) ABSTRACT

A tube pump rotor including a rotor element, a plurality of first swing portions supported pivotally at their base end portions by the rotor element, second arm-shaped swing portions supported pivotally at their base end portions individually by the first swing portions, rollers supported rotatably by the individual free ends of the second swing portions, and buffer members made to confront the side faces of the second swing portions so that the rollers may be individually directed radially outward of the rotor.

2 Claims, 6 Drawing Sheets

TUBE PUMP AND ROTOR FOR TUBE PUMP

PRIORITY CLAIM

The present application is a National Phase entry of PCT Application No. PCT/JP2008/052645, filed Feb. 18, 2008, which claims priority from Japanese Application No. 2007-039442, filed Feb. 20, 2007, the disclosures of which are hereby incorporated by reference herein in their entirety.

TECHNICAL FIELD

The present invention relates to a tube pump and a rotor for the tube pump, and more particularly, to a roller type tube pump and a rotor for the roller type tube pump.

BACKGROUND

Tube pumps required to be rotated in the normal and reverse directions are publicly known. In such a conventional tube pump, the rotor is rotated forcibly in the reverse direction without changing the mechanism thereof, because of the running time is short or the like. Several pumps of this same kind, but different in rotary direction from one another are also known.

One commercially available tube pump is disclosed in the patent materials, for example, Japanese Patent Application Laid-Open No. 218042/1994.

FIG. 4 to FIG. 6 show other conventional tube pumps, wherein reference numeral 1 denotes a housing (exterior) for mounting a resilient tube (not shown), at an inner peripheral surface of the housing, 2 denotes a rotor element maintaining a roller to be pressed to the resilient tube, 3 denotes a motor for driving the rotor element 2, 4 denotes three arm-shaped swing portions, each base end of which being supported rotatably through a shaft 5 by the rotor element 2 at each of positions equidistantly apart from one another by 120° on a circle, and each free end of which being extended in a direction different by 135°, for example, from the radial direction of the rotor element 2, 6 denotes rollers, each mounted rotatably on a free end of each swing portion 4, and 7 denotes buffer members, each inserted between the rotor element 2 and a substantial intermediate portion of the corresponding swing portion 4.

As shown in FIG. 7, each of the buffer members 7 comprises a rod 11 having a collar 8 fixed to one end thereof so as to engage with an engaging pin 9 projected from the rotor element 2, and having an elongated hole 10 formed on the other end thereof, a connecting pin 12 projected from the corresponding swing portion 4 and inserted into the corresponding elongated hole 10, and a spring 13, one end of which being contacted to the collar 8 fixed to the rod 11, and the other end of which being contacted to a substantial intermediate portion of the corresponding swing portion 4.

In the conventional tube pump, the resilient tube is pressed by the roller 6 which is positioned on the free end of the swing portion 4 and urged outwardly in the radial direction of the roller element 2 by the buffer member 7 when the rotor element 2 is rotated in the normal direction (counter-clockwise direction) 14 as shown in FIG. 6, so that the resilient tube is squeezed and liquid is sucked into the tube and exhausted from the tube.

In this case, a load 15 having pulsations specific to the tube pump in a direction across the normal direction 14 is applied to the roller 6, however, such load 15 is reduced by the spring action of the spring 13 of the buffer member 7.

SUMMARY OF THE INVENTION

In known tube pumps of the type shown in FIG. 6, wherein liquid can be sucked into and exhausted from the resilient tube even if the rotor element 2 is rotated in a reverse direction (clockwise direction) 16, a load 17 having pulsations in a direction across the direction 15 in which the load is reduced by the buffer member 7 is applied to the roller 6 when the rotor element 2 is rotated in the reverse direction 16, so that the load 17 including the pulsations cannot be reduced by the buffer member 7. Accordingly, it is necessary to increase the strength of the housing or the motor of the tube pump, if the rotor element 2 of the tube pump is rotated in the reverse direction for a long time.

Further, in case that the tube pump wherein the rotor element is rotated in the normal direction is changed to a tube pump wherein the rotor element is rotated in the reverse direction, the parts or the assembling manner of the tube pump must be changed, such that the cost is increased and a malfunction of the tube pump may occur easily.

An object of the present invention is to obviate such defects.

In one embodiment of the present invention, a rotor for a tube pump of the present invention is characterized by comprising a rotor element, a plurality of first swing portions, each base end of which being supported rotatably by the rotor element, a plurality of arm-shaped second swing portions, each base end of which being supported rotatably by the corresponding first swing portion, a plurality of rollers, each supported rotatably by a free end of the corresponding second swing portion, and a plurality of buffer members, each of which being contacted to one side surface of the corresponding second swing portion so as to urge the corresponding roller outwardly in the radial direction of the rotor element, wherein a resilient tube is squeezed by the roller when the rotor element is rotated in the normal or reverse direction, so that liquid in the resilient tube is transferred.

A tube pump of the present invention is characterized by comprising a rotor element, a housing having an arcuate inner peripheral surface surrounding at least one portion of an outer peripheral surface of the rotor element, a resilient tube arranged along the arcuate inner peripheral surface of the housing, a plurality of first swing portions, each base end portion of which being supported rotatably by the rotor element, a plurality of arm-shaped second swing portions, each base end of which being supported rotatably by each of the first swing portion, a plurality of rollers, each supported rotatably by a free end of each of the second swing portions, and a plurality of buffer members, each of which being contacted to one side surface of the corresponding second swing portion so as to urge the corresponding roller outwardly in the radial direction of the rotor element, wherein the resilient tube is squeezed by the roller when the rotor element is rotated in the normal or reverse direction, so that liquid in the resilient tube is transferred.

The buffer member comprises an extensible and compressible resilient member, one end of which being contacted to the rotor element and the other end of which being contacted to one side surface of the second swing portion, and an extensible and compressible resilient member, one end of which being contacted to the first swing portion and the other end of which being contacted to the side surface of the second swing portion, wherein a load and a pulsation to be applied to the rotor element are reduced by the extension and compression of the resilient members.

The buffer member comprises an extensible and compressible resilient member, one end of which being fixed to the rotor element and the other end of which being contacted to the second swing portion, wherein a load and a pulsation to be applied to the rotor element are reduced by the extension and compression of the resilient member.

The rotor for the tube pump of the present invention can be applied to the tube pump wherein the rotor is rotated not only in the normal direction, but also in the reverse direction, so as to reduce the pulsations and the load, and to run the tube pump for a long time.

Further, in the case where the rotor of the present invention is used for each of a plurality of tube pumps, each rotated in different directions, the same parts and assembling manner can be used, such that the cost may be reduced and the malfunction of the tube pump may be prevented.

REFERENCE NUMERAL KEY

Figure 1:
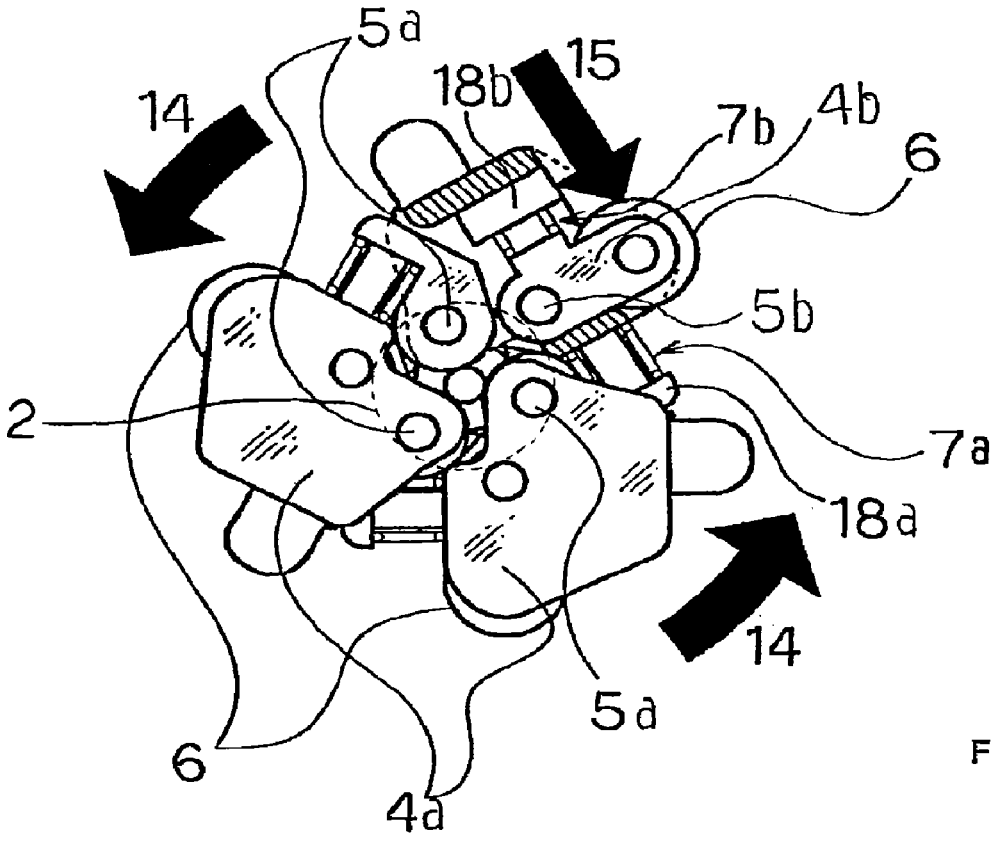
FIG. 1 is a plan view of the tube pump of an embodiment of the present invention, except for a part of a rotor.

1 housing (exterior)
2 rotor
3 motor
4 swing part
4*a* first swing portion
4*b* second swing portion
5 shaft
5*a* shaft
5*b* shaft
6 roller
7 buffer member
7*a* buffer member
7*b* buffer member
7*c* buffer member
8 collar
9 engaging pin
10 elongated hole
11 rod
12 connecting pin
13 spring
14 normal direction
15 load
16 reverse direction
17 load
18*a* receiving plate
18*b* receiving plate
19 load

DETAILED DESCRIPTION

Embodiments of the present invention will now be explained with reference to the drawings.

Figure 2:
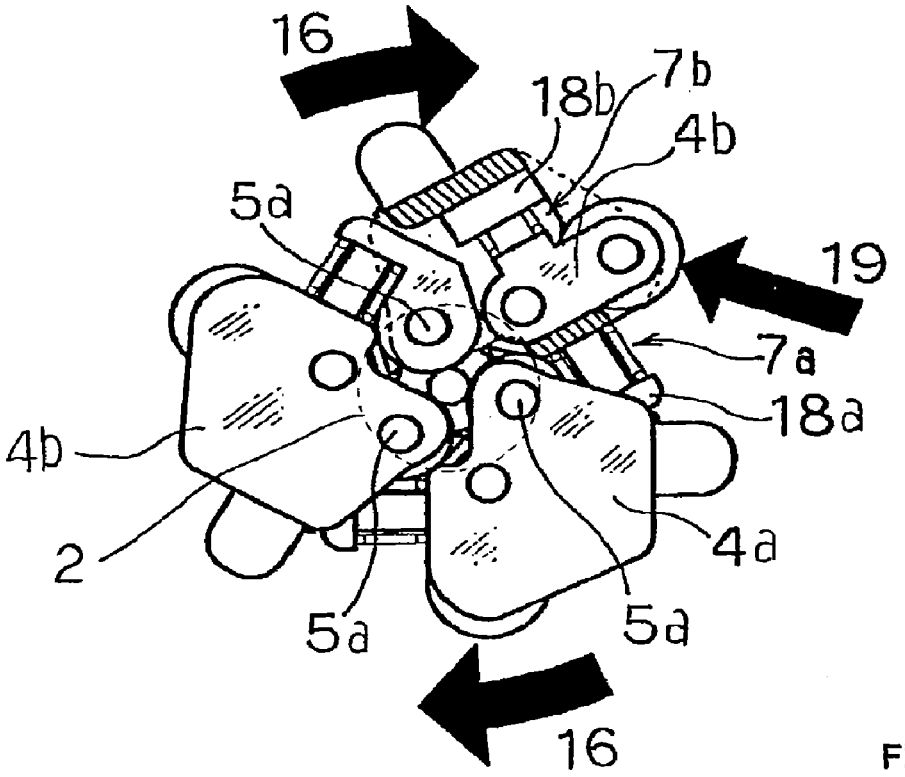
FIG. 2 is an explanatory view of the tube pump shown in FIG. 1.
Figure 1A:
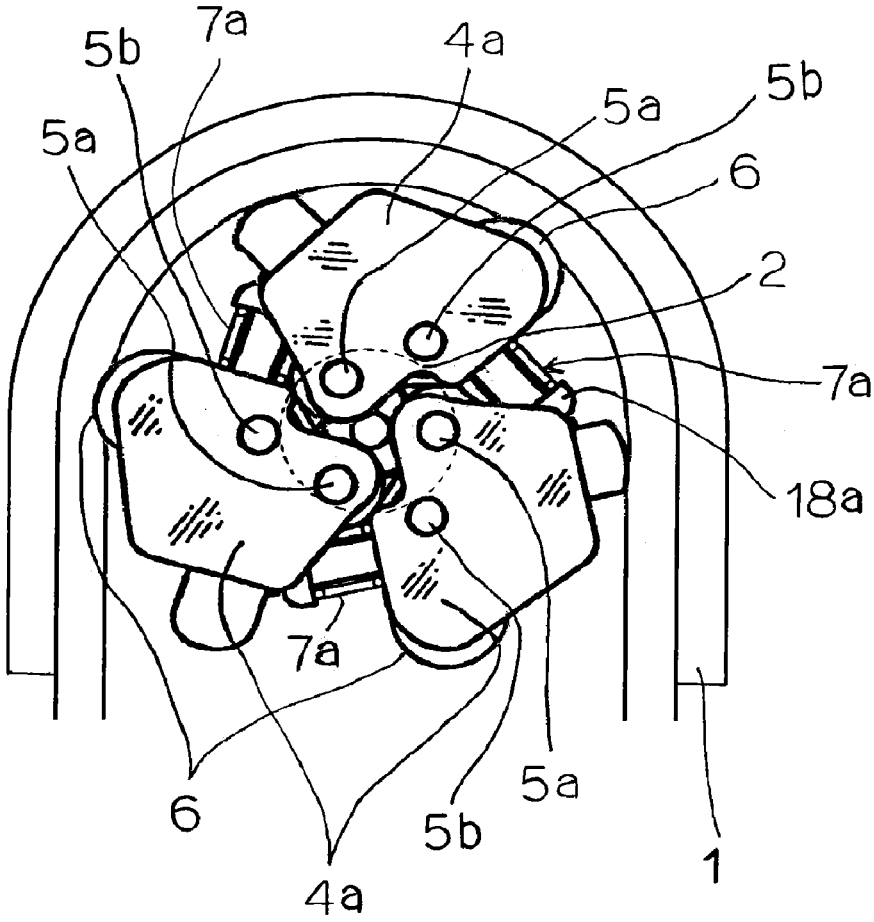
FIG. 1A is a plan view of the tube pump of an embodiment of the present invention.

A rotor for a tube pump in a first embodiment of the present invention comprises, as shown in FIG. 1 and FIG. 2, a rotor element 2, a first of three swing portions 4*a*, each base end of which being supported rotatably through a shaft 5*a* at each of positions of the rotor element 2 equidistantly apart from one another by 120° on a circle, a second of three arm-shaped swing portion 4*b*, each base end of which being supported rotatably by the rotor element 2 through a shaft 5*b* at each of positions different from each of positions for the shaft 5*a*, receiving plates 18*a*, each mounted on the rotor element 2 so as to extend outwardly from the rotor element 2 and to face a side surface of each corresponding, first swing portion 4*a*, receiving plates 18*b*, each formed on each corresponding first swing portion 4*a*, buffer members 7*a*, each consisting of a spring and inserted between the receiving plate 18*a* and the one side surface of the second swing portion 4*b*, and buffer members 7*b*, each consisting of a spring and inserted between the receiving plate 18*b* and the other side surface of the second swing portion 4*b*. Further, the first swing portions 4*a* may be fixed to the rotor element 2 by the shafts 5*a*, respectively. The corresponding first and second swing portions 4*a* and 4*b* may be fixed to each other by the corresponding shaft 5*b*. As the buffer member, a rubber, a hydraulic spring, a pneumatic spring, a torsion spring, a coil spring, and a plate spring etc. may be used.

In the tube pump of the present invention, the second swing portion 4*b* is held by the buffer members 7*a* and 7*b* so as to extend outwardly in the radial direction of the rotor element 2. Accordingly, the roller 6 at the free end of the second swing portion 4*b* urges the resilient tube when the rotor element 2 is rotated in the normal direction (counter-clockwise direction) 14, so that the resilient tube is squeezed and the liquid is sucked into and exhausted from the resilient tube. In this state, the load 15 in a direction opposite to the normal direction 14 is applied on the roller 6. However, the load 15 is reduced by the spring action of the buffer member 7*a*.

Further, in the case where the resilient tube is squeezed by the rotation of the rotor element 2 in the reverse direction 16 as shown in FIG. 2, a load 19 in a direction opposite to the direction of the load 15 is applied on the roller 6. However, the load 19 is reduced by the spring action of the buffer member 7*b*, so that the load or the pulsations can be reduced.

The rotor of the present invention can be used as a rotor for the tube motor, wherein the rotor is not only rotated either of the normal and reverse directions, but also rotated in both directions without increasing the strength of the housing 1 or the output of the motor, so that the cost of the parts and the malfunction of the assembling can be reduced.

Further, in the present invention, two, four or five pieces of the first swing portions 4*a* may be used. In case that the two first swing portions 4*a* are used, each base portion of the first swing portions 4*a* is supported rotatably by the rotor element 2 at positions equidistantly apart from each other by 180° on a circle.

In the case where four first swing portions 4*a* are used, each base end portion of the first swing portions 4*a* is supported rotatably by the rotor element 2 at positions equidistantly apart from one another by 90° on a circle. In the case where five first swing portions 4*a* are used, each base end portion of the first swing portion 4*a* is supported rotatably by the rotor element 2 at positions equidistantly apart from one another by 72° on a circle.

Figure 3:
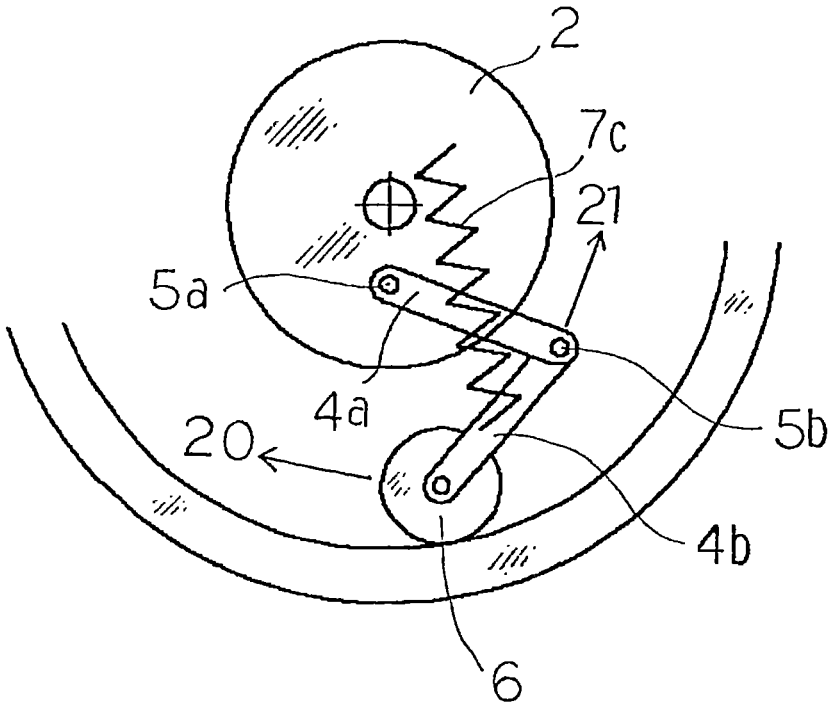
FIG. 3 is another embodiment of the tube pump of the present invention.
Figure 4:
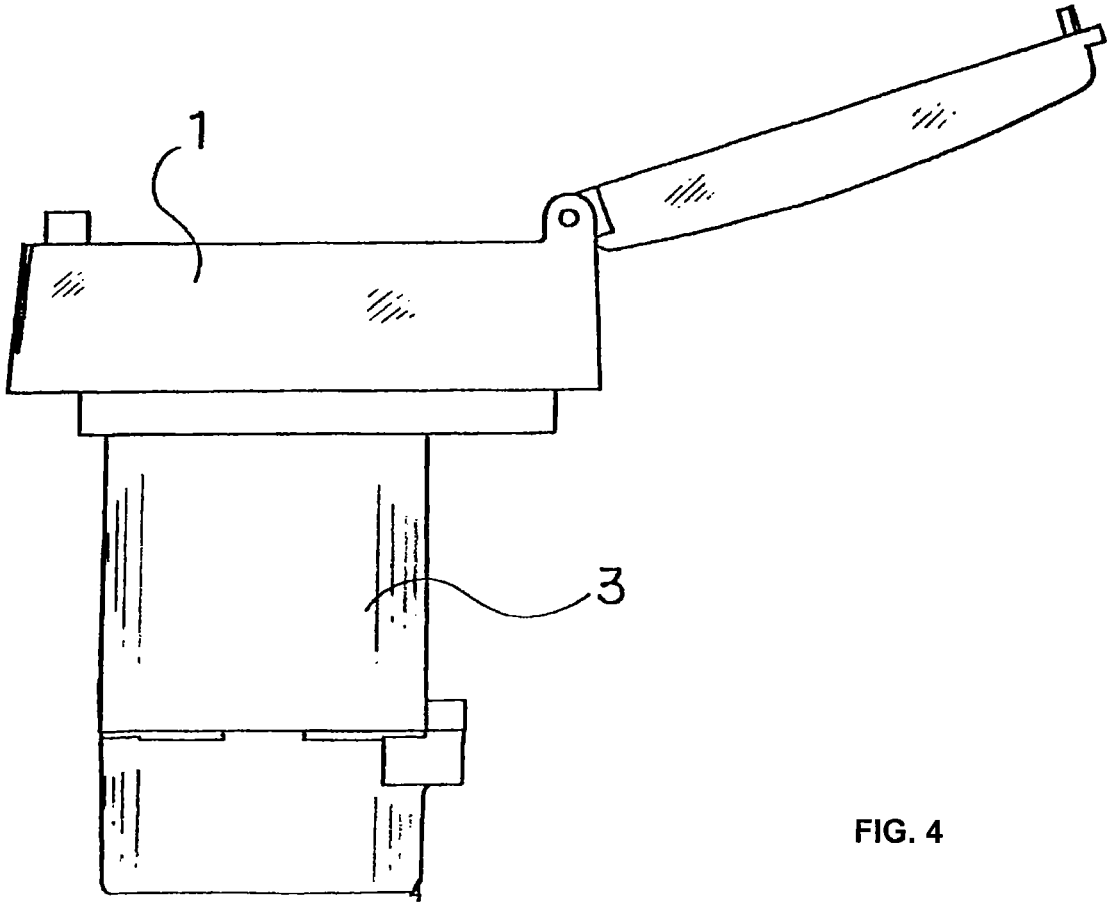
FIG. 4 PRIOR ART
FIG. 4 is a front view of a conventional tube pump.
Figure 5:
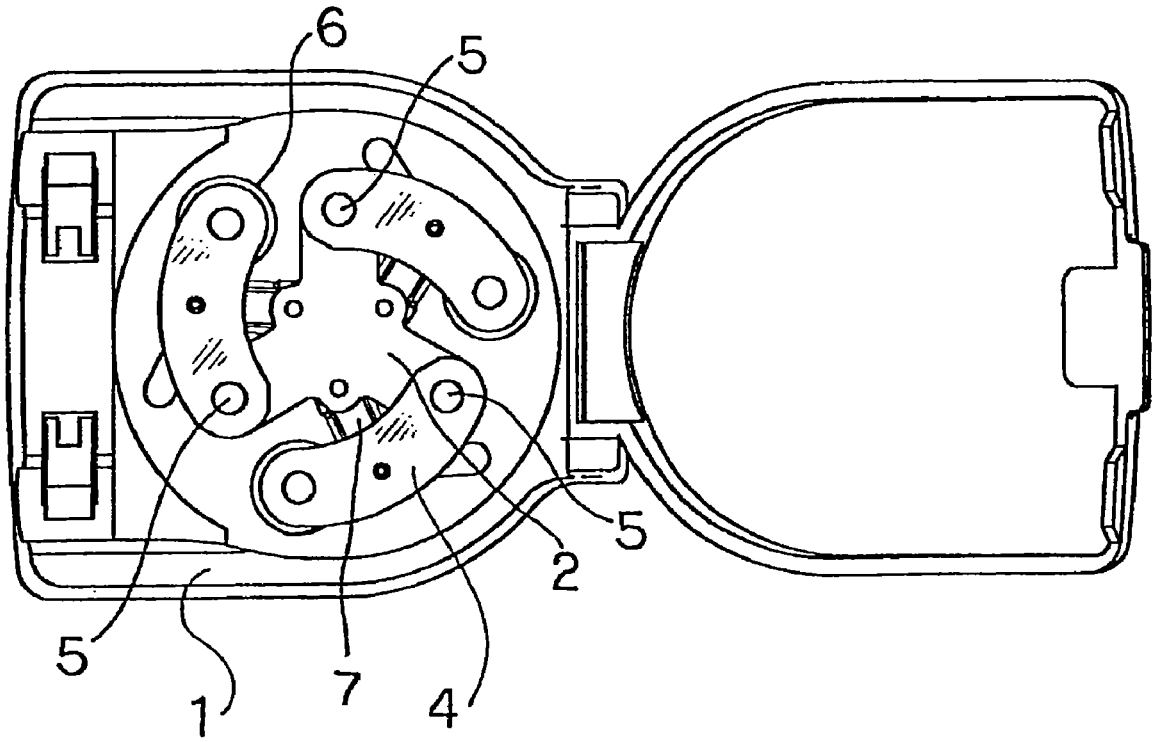
FIG. 5 PRIOR ART
FIG. 5 is a plan view of the tube pump shown in FIG. 4.
Figure 6:
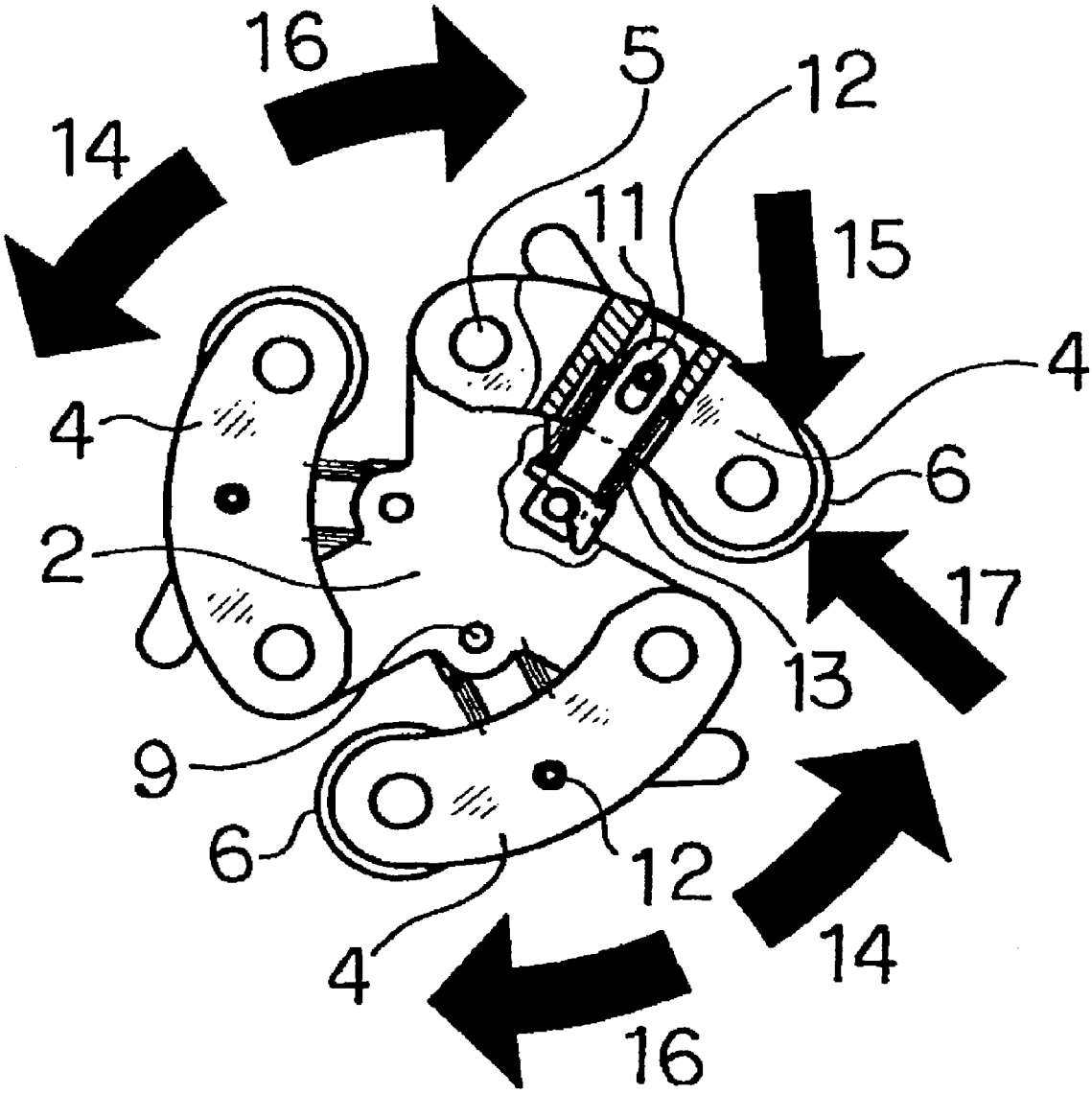
FIG. 6 PRIOR ART
FIG. 6 is an operational, explanatory view of the tube pump shown in FIG. 4.
Figure 7:
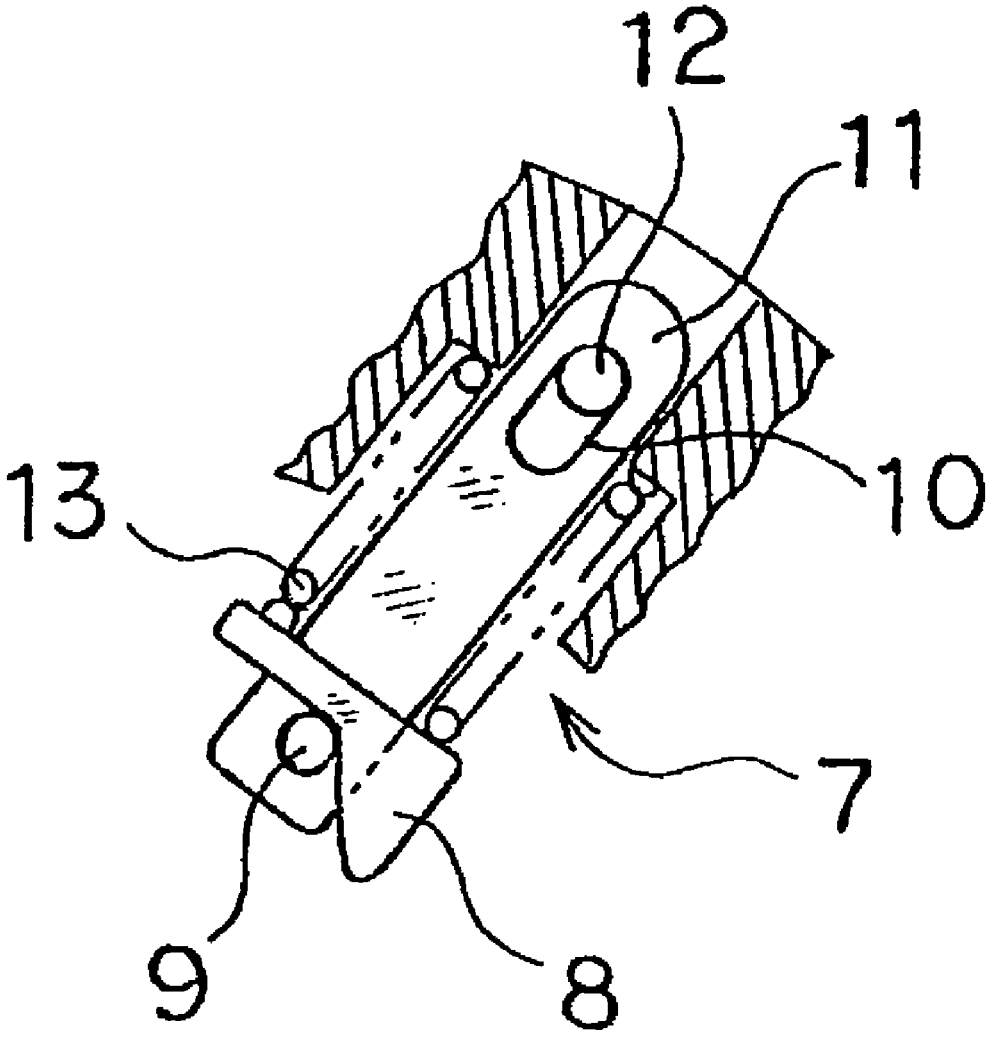
FIG. 7 PRIOR ART
FIG. 7 is an enlarged plan view of a part of the tube pump shown in FIG. 4.

In another embodiment of the present invention, as shown in FIG. 3, one end of a buffer member 7*c* is fixed to the rotor element 2, the other end of the buffer member 7*c* is fixed to the second swing portion 4*b*, and the buffer member 7*c* may be oriented in parallel to a line connecting a center of the rotor 2 and a center of the roller 6. According to this embodiment, a pressure force due to the second swing portion 4*b* and the buffer member 7*c*, mainly is applied to the roller 6 as a counter force to a load 20, and a pressure force due to the first swing portion 4*a* and the buffer member 7*c*, mainly is applied to the roller 6 as a counter force to a load 21 in a direction normal to a direction of the load 20.

The invention claimed is:

1. A rotor for a tube pump comprising:

a rotor element;

a plurality of first swing portions, each first swing portion having a base portion supported rotatably by the rotor element about an axis defined by a shaft disposed on the rotor;

a plurality of arm-shaped second swing portions, each second swing portion corresponding to a first swing portion and having a base end supported rotatably by the corresponding first swing portion about an axis defined by a swing shaft; wherein each second swing portion has a roller supported rotatably on a free end thereof;

a plurality of first buffer members, each first buffer member inserted between a first side surface of each second swing portion and a receiving plate mounted on the rotor element; a plurality of second buffer members, each second buffer member inserted between a second side surface of each second swing portion and a receiving plate mounted on the corresponding first swing portion; wherein each second swing portion is biased in opposite directions by corresponding first and second buffer members, each second swing portion being suspended therebetween; and wherein a resilient tube is squeezed by at least one of the rollers when the rotor element is rotated in a normal counter-clockwise direction or a reverse clockwise direction, so that liquid in the resilient tube is transferred.

2. The rotor as claimed in claim 1, wherein each of the first and second buffer members comprises an extensible and compressible resilient member, wherein a load and a pulsation to be applied to the rotor element are reduced by the extension and compression of the resilient members when the rotor element is rotated in the normal counter-clockwise direction or the reverse clockwise direction.

* * * * *